US011134729B1

(12) United States Patent
Schwartz et al.

(10) Patent No.: US 11,134,729 B1
(45) Date of Patent: Oct. 5, 2021

(54) APPARATUS FOR SAFE EATING AND DRINKING IN PUBLIC DURING AIRBORNE CONTAMINATION

(71) Applicant: University of Puerto Rico, San Juan, PR (US)

(72) Inventors: Abraham Schwartz, San Juan, PR (US); Gary Woodward, McLean, VA (US); Ricardo Nieves Santiago, Bayamon, PR (US); Veronica Del Mar Diaz Rivera, Bayamon, PR (US); Abigail Toledo Rosado, Bayamon, PR (US); Jessiry Abreu Cruz, Humacao, PR (US); Paola Rodriguez Rivera, Mayaguez, PR (US); Emma Fernandez Repollet, San Juan, PR (US)

(73) Assignee: University of Puerto Rico, San Juan, PR (US)

( * ) Notice: Subject to any disclaimer, the term of this patent is extended or adjusted under 35 U.S.C. 154(b) by 0 days.

(21) Appl. No.: 17/128,420

(22) Filed: Dec. 21, 2020

(51) Int. Cl.
*A41D 31/02* (2019.01)
*A41D 27/28* (2006.01)
(Continued)

(52) U.S. Cl.
CPC ..... *A41D 13/1107* (2013.01); *A41D 13/11* (2013.01); *A41D 13/1176* (2013.01);
(Continued)

(58) Field of Classification Search
CPC ..... A61M 16/06; A61M 2202/0225; A61M 16/0066; A61M 16/0672; A61M 16/0683; A61M 16/0816; A61M 16/0825; A61M 16/16; A61M 16/20; A61M 2202/0085; A61M 2205/42; A61M 16/00; A61M 16/0057; A61M 16/0069; A61M 16/009;
(Continued)

(56) References Cited

U.S. PATENT DOCUMENTS 5,513,458 A * 5/1996 Dehli ..... G09F 19/12 40/437
7,958,889 B1 * 6/2011 Fernandez-DeCastro ..... A62B 18/086 128/202.15

(Continued)

FOREIGN PATENT DOCUMENTS

CA 2124780 A1 * 12/1995 ..... A42B 3/222

*Primary Examiner* — Dionne Pendleton
(74) *Attorney, Agent, or Firm* — Hoglund & Pamias, PSC; Roberto J. Rios

(57) ABSTRACT

The invention provides an equipment and a system that addresses the key concerns of eating/drinking in public while minimizing the chance of contamination of the eater and the public in general. The equipment can be a face mask, a face shield or a helmet that completely encloses at least the mouth and the nose of a person while providing intermittent access to the mouth without removal of the equipment. A mouth opening is provided on the equipment which is selectively blocked or unblocked by a covering element moved by a moving mechanism that moves the cover element to block or unblock the mouth opening. The mouth opening is selectively blocked or unblocked based on the distance between an activating element provided on a utensil or a wearable device and a receiving element provided on the equipment.

21 Claims, 6 Drawing Sheets

(51) Int. Cl.

| | |
|---|---|
| ***A62B 18/04*** | (2006.01) |
| ***A41D 13/11*** | (2006.01) |
| ***A62B 18/02*** | (2006.01) |
| ***A62B 18/08*** | (2006.01) |
| ***G08C 17/02*** | (2006.01) |
| ***G08C 17/04*** | (2006.01) |
| ***A42B 3/00*** | (2006.01) |
| ***A62B 18/00*** | (2006.01) |
| ***A42B 3/32*** | (2006.01) |
| *A62B 23/02* | (2006.01) |

(52) U.S. Cl.
CPC ..... *A41D 13/1184* (2013.01); *A42B 3/00* (2013.01); *A42B 3/326* (2013.01); *A62B 18/00* (2013.01); *A62B 18/02* (2013.01); *A62B 18/025* (2013.01); *A62B 18/04* (2013.01); *A62B 18/086* (2013.01); *G08C 17/02* (2013.01); *G08C 17/04* (2013.01); *A41D 2300/30* (2013.01); *A62B 23/025* (2013.01); *G08C 2201/91* (2013.01)

(58) Field of Classification Search
CPC ..... A61M 16/024; A61M 16/0605; A61M 16/0616; A61M 16/0666; A61M 16/0875; A61M 16/1095; A61M 16/201; A61M 16/205; A61M 16/208; A61M 2016/0027; A61M 2016/0033; A61M 2205/3375; A61M 2205/3569; A61M 2205/3592; A61M 2205/50; A61M 2205/582; A61M 2210/02; A61M 5/329; A61M 2202/0208; A61M 16/0611; A61M 2207/00; A61M 16/0463; A61M 16/0622; A61M 16/0633; A61M 16/0688; A61M 16/10; A61M 16/1055; A61M 16/107; A61M 16/109; A61M 16/12; A61M 2016/0661; A61M 2205/0216; A61M 2205/3368; A61M 2210/0612; A61M 2210/0618; A61M 2210/0625; A61M 35/10; A41D 13/11; A41D 13/0025; A41D 13/1153; A41D 13/113; A41D 13/1161; A41D 13/1176; A41D 13/1209; A41D 13/1218; A41D 13/1107; A41D 31/18; A41D 13/001; A41D 13/1184; A41D 13/1169; A61B 5/6803; A61B 7/02; A61B 2560/0214; A61B 2560/0257; A61B 2562/0247; A61B 5/0004; A61B 5/083; A61B 5/0833; A61B 5/0836; A61B 5/097; A61B 5/107; A61B 5/1077; A61B 5/6819; A61F 9/025; A61F 13/122; A61F 13/124; A61F 2002/4435; A61F 9/02; A61F 9/027; A61L 2430/38; A61L 27/16; A61L 27/20; A61L 27/48; A61P 19/00; A63B 21/00058; A63B 21/0085; A63B 21/4003; A63B 23/18; B01D 2253/102; B01D 2259/40009; B01D 2259/4541; B01D 53/04; B01D 53/0407; B01D 53/0454; B63C 11/22; B63C 11/32; B64D 11/00; B64D 2231/025; B65B 55/02; B65B 5/04; B67D 1/0005; B67D 1/0888; B67D 1/10; B67D 1/1243; B67D 2001/0097; B67D 2210/00131; C08L 33/12; C08L 5/08; F04B 45/047; F16K 11/072; F16K 11/0873; F16K 31/02; F16K 5/0407; F16L 37/00; F16L 37/088; F16L 37/091; G09B 19/24; G09B 9/00; Y10S 128/912; G16H 40/67; G16H 20/40; G16H 50/50; A41F 1/002; A42B 3/222; A42B 3/288; A42B 3/0486; A42B 3/226; A42B 3/24; A42B 3/326; A42B 3/328; A42B 1/046; A42B 3/20; A42B 3/225; A42B 3/28; A42B 3/286; A42B 3/30; A42B 3/322; A45D 44/002; A45F 2003/166; A45F 3/16; A62B 18/003; A62B 18/086; A62B 18/02; A62B 18/025; A62B 18/084; A62B 23/025; A62B 7/10; A62B 9/006; A62B 18/08; A62B 18/10; A62B 7/02; A62B 9/00; A62B 9/003; A62B 9/02; A62B 18/006; A62B 18/04; A62B 23/00; A62B 23/06; A62B 25/00; A62B 27/00; A62B 7/00; A62B 7/08; A62B 9/04; Y10T 24/45461; A01K 55/00; G06T 15/10; G06T 19/00; G06T 19/20; G06T 2210/41
See application file for complete search history.

(56) References Cited

U.S. PATENT DOCUMENTS

| | | | | |
|---|---|---|---|---|
| 10,905,905 | B1 * | 2/2021 | Dettore | A62B 18/086 |
| 10,912,959 | B1 * | 2/2021 | Showalter | A62B 18/086 |
| 2005/0012475 | A1 * | 1/2005 | Takeuchi | H02K 51/00 318/34 |
| 2005/0126566 | A1 * | 6/2005 | Stone | A62B 18/086 128/202.15 |
| 2016/0332008 | A1 * | 11/2016 | McAndrews | A62B 18/084 |
| 2020/0329792 | A1 * | 10/2020 | Howard | A41D 13/11 |
| 2020/0376305 | A1 * | 12/2020 | Lang | A62B 18/025 |
| 2020/0404991 | A1 * | 12/2020 | Karakostas | A41D 13/11 |
| 2021/0052922 | A1 * | 2/2021 | Chen | A41D 31/30 |
| 2021/0086005 | A1 * | 3/2021 | O'Brien | A61L 27/16 |
| 2021/0127773 | A1 * | 5/2021 | Lowder | A42B 3/00 |

* cited by examiner

APPARATUS FOR SAFE EATING AND DRINKING IN PUBLIC DURING AIRBORNE CONTAMINATION

TECHNICAL FIELD

The invention is directed to the medical equipment field. Specifically, the invention is directed to personal protection equipment used to prevent air-borne diseases. More, specifically, the invention is directed to a personal protection equipment incorporating a system that allows a user to eat or drink without removing the personal protection equipment.

BACKGROUND OF THE INVENTION

The most difficult type of pandemic pathogen to avoid is the air-borne viral particles that may be spread via droplets from the nose or mouth by talking, singing, sneezing, coughing, etc. If the infectious particles can form suspended aerosols, the danger is maintained for an extended period where the particles can be transferred, via breathing to and from other persons. Additionally, the particles can settle on surfaces where they may be transferred to others by first touching the contaminated surface, then touching their own nose, mouth, and eyes.

Presently, the most common way to avoid air-borne contamination is by using some form of barrier, e.g., a mask or face shield. Using these methods for long periods can be uncomfortable since they are usually worn on the head and may not fit well enough such that there are gaps where the infectious particles can pass on to the wearer.

The biggest problem under pandemic conditions is eating and drinking in the presence of other people, e.g., at a restaurant, diner with guests, party or sports event. The simple act of safely ingesting food becomes problematic since the mask or face shield needs to be lifted requiring one or both hands. The period of exposure during this act may be enough to contaminate a person.

Thus, what is needed is an equipment and a system that allows a user to eat or drink without removing the mask or face shield.

SUMMARY OF THE INVENTION

The present invention addresses the key concerns of eating/drinking in public while minimizing the chance of contamination of the eater and the public in general.

According to an aspect of the invention, an equipment is provided that completely encloses the mouth of a person while providing intermittent access to the mouth without removal of the equipment or device.

According to another aspect of the invention, an equipment is provided that completely encloses the mouth and the nose of a person while providing intermittent access to the mouth without removal of the equipment or device.

According to still another aspect of the invention, an equipment is provided that completely encloses the head of a person while providing intermittent access to the mouth without removal of the equipment or device.

According to yet another aspect of the invention, a mouth opening is provided on the equipment which is selectively blocked or unblocked to control access to the mouth.

According to one aspect of the invention, a cover element is provided which is selectively moved to block or unblock the mouth opening.

According to another aspect of the invention, the cover element is coupled to a moving mechanism that moves the cover element to block or unblock the mouth opening.

According to one aspect of the invention, the moving mechanism linearly moves the cover element in relation to the mouth opening.

According to another aspect of the invention, the moving mechanism rotatably moves the cover element in relation to the mouth opening.

According to an aspect of the invention, the moving mechanism is preferably a servomotor.

According to still another aspect of the invention, a utensil is provided with an activating element so that the moving mechanism moves the cover element based at a predefined distance between the utensil and the mouth opening.

According to yet another aspect of the invention, the mouth opening remains unblocked so long as the utensil is within a predetermined distance of the moving mechanism, the mouth opening and/or the receiving element.

According to still another aspect of the invention, the mouth opening is blocked when the utensil is moved away from the mouth opening at a distance greater than a predefined distance of the moving mechanism, the mouth opening and/or the receiving element.

According to another aspect of the invention, the mouth opening remains unblocked for a predefined amount of time.

According to an aspect of the invention, the utensil can be any element that can be used by a person to aid in eating or drinking.

According to another aspect of the invention, the utensil can be a fork, a spoon, a knife, chopsticks, tongs, a cup, a spatula, a turner, a food grabbing element or a straw.

According to yet another aspect of the invention, the equipment can be a facemask, a face shield, or a full helmet.

According to still another aspect of the invention, a RF transceiver module is provided on the face protective equipment and the activating element is a RFID tag on the utensil.

According to one aspect of the invention, the RFID tag transmits the activating signal so that said moving mechanism moves the cover element to block or unblock the mouth opening.

According to yet another aspect of the invention, the activating signal is received by the RF transceiver module.

According to still another aspect of the invention, a first magnetic module is provided on the face protective equipment and the activating element is a second magnetic module on the utensil.

According to another aspect of the invention, the moving mechanism moves the cover element to unblock the mouth opening when the second magnetic module is within a predefined distance from the first magnetic module.

According to another aspect of the invention, an infrared (IR) sensor is provided on the face protective equipment and the activating element is an IR light source on the utensil.

According to one aspect of the invention, the moving mechanism moves the cover element to unblock the mouth opening when the IR sensor detects the presence of the IR light source.

According to another aspect of the invention, a processing module is provided to determine if the utensil is within a predefined distance of the mouth opening.

According to yet another aspect of the invention, the cover element is selectively moved to block or unblock the mouth opening based on a determination made by the processing module.

BRIEF DESCRIPTION OF THE DRAWINGS

Further features and advantages of the invention will become apparent from the following detailed description taken in conjunction with the accompanying figures showing illustrative embodiments of the invention, in which.

Throughout the figures, the same reference numbers and characters, unless otherwise stated, are used to denote like elements, components, portions or features of the illustrated embodiments. The subject invention will be described in detail in conjunction with the accompanying figures, in view of the illustrative embodiments.

DETAILED DESCRIPTION OF THE INVENTION

The protection equipment and the system of the present invention comprise of a protective covering (3), for the nose and the mouth of a person, that includes a mouth opening (4) provided on a front area of the protective covering (3) and positioned in front of the mouth of the person. A covering element (5) is provided to selectively cover the mouth opening (4) in the protective covering (3). The covering element (5) comprises a material impervious to airborne contaminants and is large enough and provided close enough to the mouth opening (4) such that it can block airborne contaminants from entering inside the protective covering (3). The cover element (5) is coupled to a moving mechanism (6) that mechanically moves the covering element (5) to selectively block and unblock the mouth opening (4).

Figure 1:
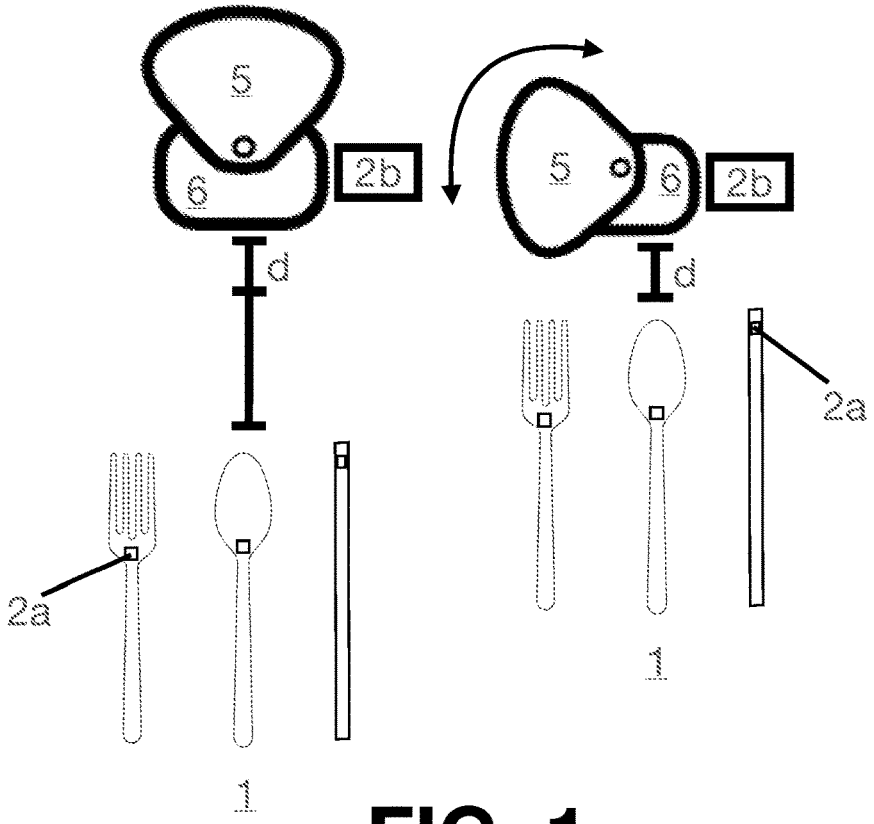
FIG. 1 shows the system of the present invention where the covering element is rotatably moved by the moving mechanism based on the proximity of a utensil.
Figure 2:
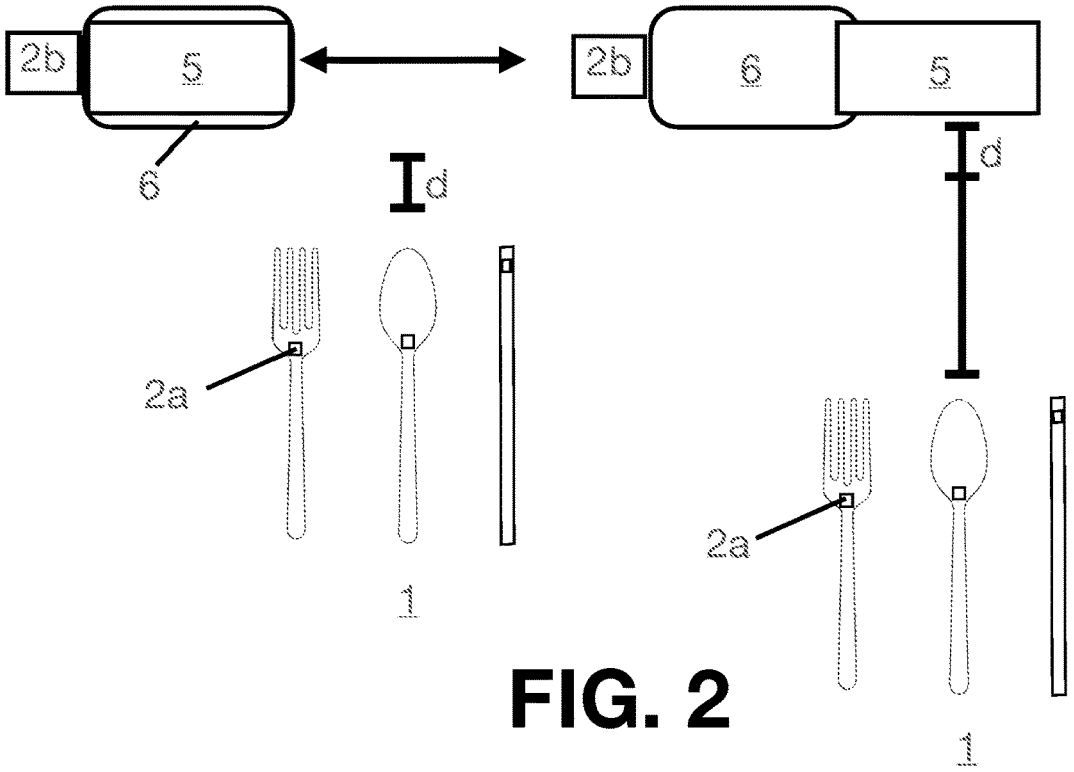
FIG. 2 shows the system of the present invention where the covering element is linearly moved by the moving mechanism based on the proximity of a utensil.

As can be appreciated in FIG. 1 and FIG. 2, the moving mechanism (6) can move the cover element (5) linearly (FIG. 2) or rotationally (FIG. 1) in relation to the mouth opening (4). The mechanical components needed to control the moving mechanism (6)/covering element (5) arrangement are well known in the art and out of the scope of the present invention. However, for the purpose of understanding the invention, some non-limiting examples are disclosed. According to an embodiment illustrated in FIG. 1, the moving mechanism (6) is a servomotor with an output shaft coupled to the covering element (5) that will be rotationally moved in relation to the mouth opening (4) when the output shaft of the servomotor (6) rotates in a clockwise or counterclockwise direction to selectively block or unblock the mouth opening (4). In the embodiment illustrated on FIG. 2, the moving mechanism (6) is a servomotor with an output shaft having a linear actuator coupled to the covering element (5) that will be linearly moved in relation to the mouth opening (4) when the output shaft of the servomotor (6) rotates in a clockwise or counterclockwise direction to selectively block or unblock the mouth opening (4). Thus, the covering element (5) can be moved horizontally, vertically or diagonally in relation to the mouth opening (4). In either embodiment, the servomotor (6) can be driven by a double pole double throw electrical circuit that when activated rotates the servomotor such that the covering element (5) blocking the mouth opening (4) is moved out of the way of the mouth opening, and vice versa. The servomotor and all the circuitry/processors/modules needed to carry out the invention can be powered by a battery (e.g., rechargeable, replaceable, condenser, etc. . . . ). Furthermore, the speed of rotation of the servomotor (6) as well as the angular/linear distance and movement limits are selectively programmed into the processing module (7) at manufacture and/or on-demand by a person. Specifically, it is important that speed of rotation of the servomotor (6), the angle of rotation (or linear distance movement) of the covering element (5) to reach a complete unblock of the mouth opening (4) as well as the angle of rotation (or linear distance movement) of the covering element (5) to reach a partial unblock of the mouth opening (4) are selected based at least on the space available inside the protective covering (3), the overall size of the mouth of the person in relation to the size of the mouth opening (4) and/or the peripheral boundaries of the mouth opening (4). For example, assuming a round mouth opening (4) with a diameter of 3 inches, an initial blocked positioned can be set as a 0° (or 0 inches), a partial unblocked positioned can be set between 50°-90° of rotation (or 1-2 inches of displacement) and a complete unblocked positioned can be set as 180° of rotation (or 3 inches of displacement). It is to be understood, that the final parameters will be selected on a case-by-case basis depending on the person using the system of the present invention to ensure that the mouth opening (4) remains unblocked only as necessary and blocked as fast as possible in order to minimize any exposure to air-borne diseases.

Figure 7:
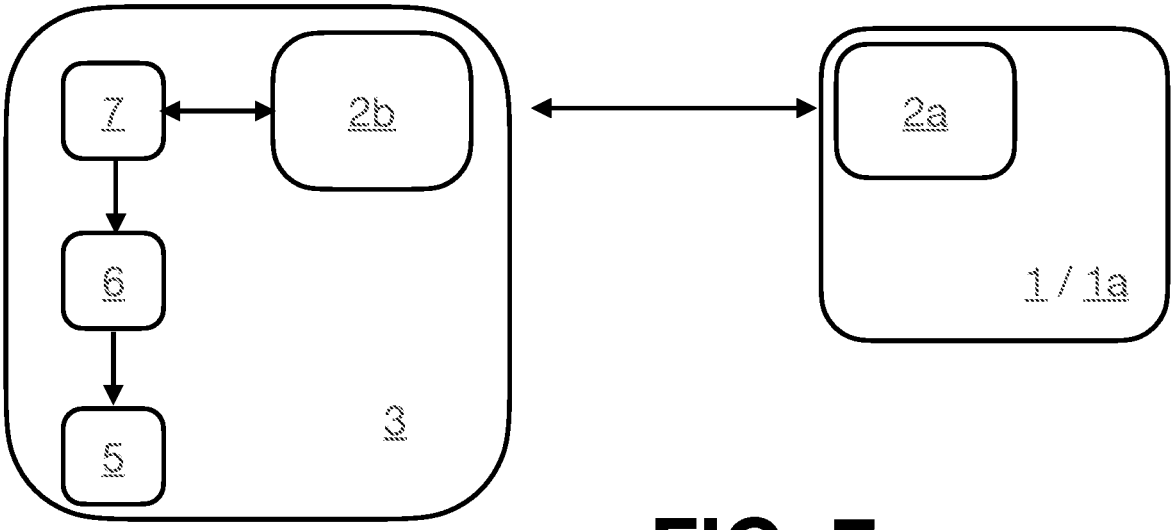
FIG. 7 shows a block diagram of the components of the system according to the present invention.

FIG. 7 illustrates the basic components of the system according to the invention. The protective covering (3) is provided with the receiving element (2*b*) which is connected to a processing module (7). An output of the processing module (7) is connected to the moving mechanism (6) that has an output shaft coupled to the covering element (5). While FIG. 7 illustrates the receiving element (2*b*), the processing module (7), the moving mechanism (6) and the covering element (5) as separate components, it is to be understood that at least some or all of the components can be provided as a single integrated module. In addition, one of the main functions of the processing module (7) is to receive and process a signal associated to the proximity of the utensil (1) to the mouth opening (4) and to generate a controlled output to selectively actuate the moving mechanism (6) so that the covering element (5) is moved as desired. While the specific hardware and associated software of the processing module (7) form no part of the invention, already available off-the-shelf (OTS) systems can be used as the processing module (7) and/or the receiving element (2*b*)

according to the present invention as long as it contains at least a processing unit, memory means, mass storage means, input and output means. Some non-limiting examples can be an Arduino system, a PLC system, a computer system, a raspberry Pi system or combinations thereof. Other well-known components can be also be added and/or used if needed to carry out and implement the method and the system of the present invention.

As part of the inventive system, an activating device (1/1*a*) is provided with an activation element (2*a*) configured to interact with an equipment receiving element (2*b*) provided on the protective covering (3) in order to control movement of the moving mechanism (6). For the purpose of this invention, the activating device can be a utensil (1) or a person wearable device (1*a*). As can be appreciated, a utensil is any element, equipment, gear, device or any equivalents thereof that can be used by a person for eating or drinking. Some non-limiting examples of a utensil according to the invention are a fork, a spoon, a knife, chopsticks, tongs, a cup, a spatula, a turner, a food grabbing element or a straw. Thus, the activation element (2*a*) can be integrated or removably coupled to anything that will be in proximity to a person's mouth while a person is eating or drinking. For example, the activation element (2*a*) can be part of a removable label/sticker that can be affixed to a utensil (1) or the activation element (2*a*) can be provided with a fixing element such as but not limited to a hook and loop fastener for removably fasten the activation element (2*a*) to the utensil (1). Alternatively, the activation element (2*a*) can be integrally formed with the utensil as a one-piece activating device.

According to another embodiment, the activation element (2*a*) is provided on a device wearable by the person. The wearable device (1*a*) includes at least the activation element (2*a*) and any circuitry necessary to carry out the method of the present invention. As will be explained below, the activation element (2*a*) on the wearable device (1*a*) also interacts with the equipment receiving element (2*b*) to block or unblock the mouth opening (4). In an embodiment illustrated in FIGS. 6*a* and 6*b*, the wearable device (1*a*) is a device wore by the person on the hand such as but not limited to a glove, a wristband, a watch, smartwatch, a bracelet or a ring.

The activation element (2*a*) generates a wireless activating signal that is received by the receiving element (2*b*) when the activation element (2*a*) is within a predefined distance d from said receiving element (2*b*). For the purpose of the invention, a predefined distance d can be a range such as but not limited to between 1-8 inches or a fixed distance such as but not limited to 4 inches. It is also envisioned, that the generated wireless activating signal can be received by the receiving element (2*b*) independent of the distance between the receiving element (2*b*) and the activation element (2*a*).

According to a preferred embodiment of the invention, the receiving element (2*b*) is a radio-frequency identification (RFID) transceiver module provided on the protective covering (3) and the activation element (2*a*) is a RFID tag that transmit a RFID signal. A Near-Field Communication (NFC) tag/transceiver arrangement can also be used, especially for short or limited communication distances. One important aspect of the invention is that the activating device used by the person needs to be associated with the protective covering (3) worn by the person. This can be accomplished by several ways. For example, the RFID/NFC tag (2*a*) can be preprogrammed at manufacture with the specific ID associated to the RFID/NFC transceiver module provided on the protective covering (3). It is also envisioned, that the specific ID can be programmed into the RFID/NFC tag (2*a*) after manufacture. For example, the RFID/NFC transceiver module provided on the protective covering (3) can be used to program and/or reprogram the specific ID into the RFID/NFC tag (2*a*). Alternatively, the specific ID can be programed and/or reprogramed into the RFID/NFC tag (2*a*) by an external device such as, but not limited to a RFID/NFC-enabled portable device, a RFID/NFC-enabled computer or peripheral.

In addition, the system of the invention is able to distinguish between situations where the mouth opening (4) can be partially unblocked (e.g., using a straw) and situations where the mouth opening (4) must be completely unblocked (e.g., using a fork). For example, this can be accomplished by providing an ID to utensils that require complete unblocking of the mouth opening (4) and a different ID to utensils that only require partial unblocking of the mouth opening (4). The receiving element (2*b*) is able to recognize the different IDs and the moving mechanism (6) will be actuated to selectively move the covering element (5) to either partially unblock or completely unblock the mouth opening (4) based on the ID signal received.

It is to be understood, that without departing from the spirit of the invention, as long as the activation signal serves to associate the activating device with the protective covering (3), other wireless protocols can be used to transmit the activating signal such as but not limited to: Bluetooth, Bluetooth Low Energy (BLE), ZigBee, Z-Wave, 6LoWPAN, Thread, 2G, 3G, 4G, LTE, GSM, NB-IoT, 5G, SigFox, LoRaWAN, Ingenu, Weightless-N/P/W, ANT(+), DigiMesh, MiWi, EnOcean, Dash7, WirelessHART, and WIFI.

According to other embodiments, the system and method of the invention can also be implemented using a magnetic arrangement or an infra-red (IR) arrangement. Specifically, the receiving element (2*b*) can be a first magnetic module and the activating element (2*a*) can be a second magnetic module where for example, the pole of a magnet in the circuitry of the processing module (7) or in the receiving element (2*b*) is matched or opposed to that of a magnet attached or incorporated into the activating device (1/1*a*). Alternatively, the receiving element (2*b*) can be an IR sensor and the activating element (2*a*) can be an IR light source attached to or built into the activating device (1/1*a*) that activates an infrared sensor to operate the servomotor according to the present invention. Regardless of the activating arrangement used, the distance between the receiving element (2*b*) and the activating element (2*a*) is the determining factor used the actuate the moving mechanism (6) that selectively moves the covering element (5) between a blocked and an at least partially unblocked position.

The method of operation of the present invention will be explained below in conjunction with FIGS. 3*a*-6*b*. While the specific communication protocols used to carry out the method are known in the art and form no part of the present invention, one possible RFID/NFC arrangement will be used to explain the following non-limiting examples of the invention. Also, while a fork is used as an exemplary utensil, it must be understood that the same operating principle will apply to other utensils like a spoon or a straw.

Figure 3B:
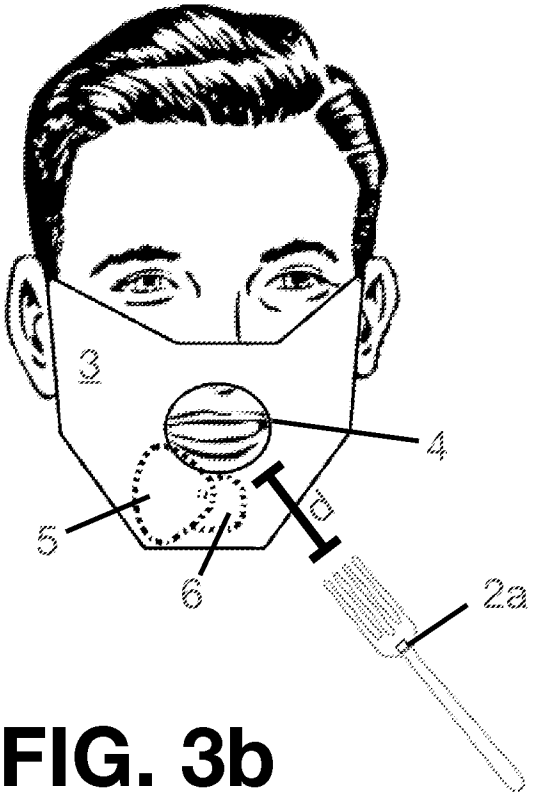
FIG. 3*b* shows the system of the present invention implemented on a face mask where the utensil is within a predefined distance from the face mask.
Figure 3A:
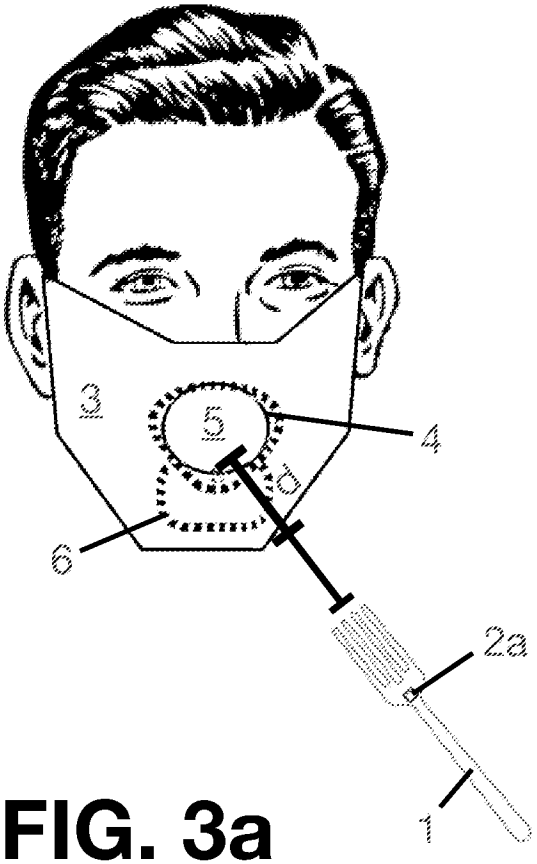
FIG. 3*a* shows the system of the present invention implemented on a face mask where the utensil is outside a predefined distance from the face mask.
Figure 4B:
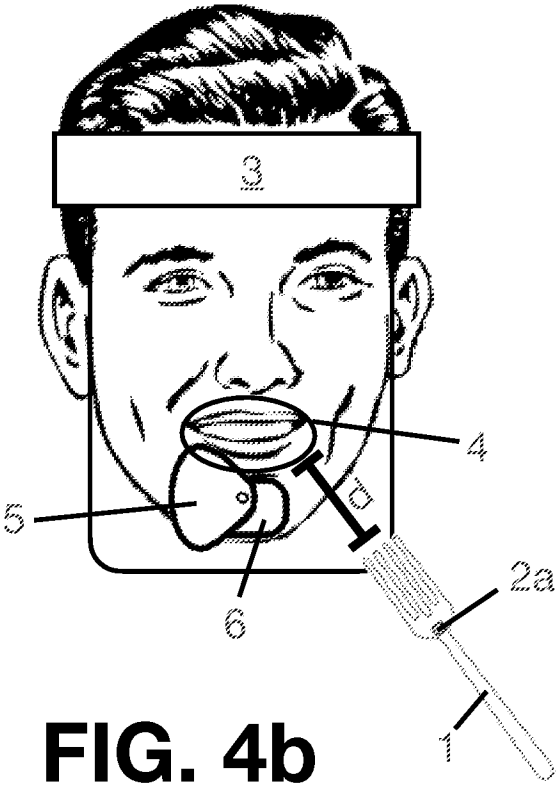
FIG. 4*b* shows the system of the present invention implemented on a face shield where the utensil is within a predefined distance from the face shield.
Figure 4A:
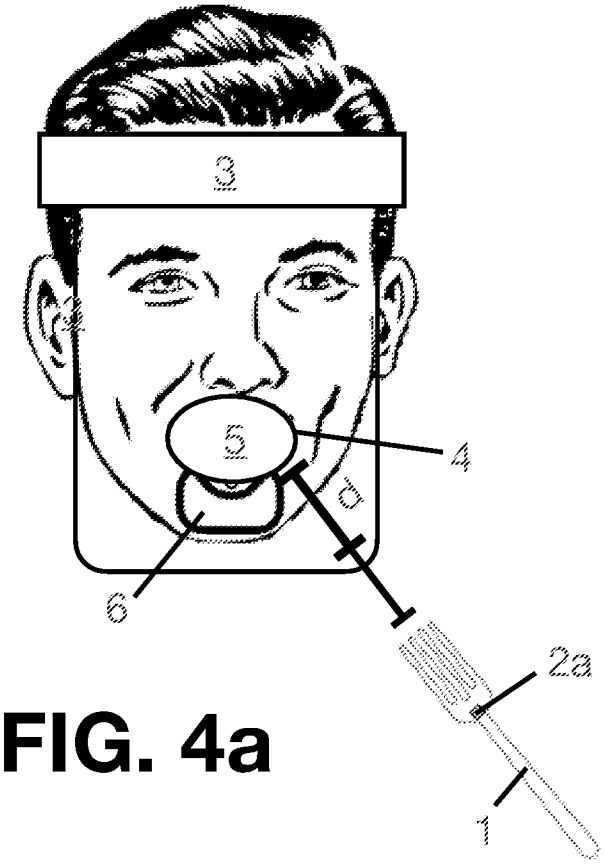
FIG. 4*a* shows the system of the present invention implemented on a face shield where the utensil is outside a predefined distance from the face shield.
Figure 5B:
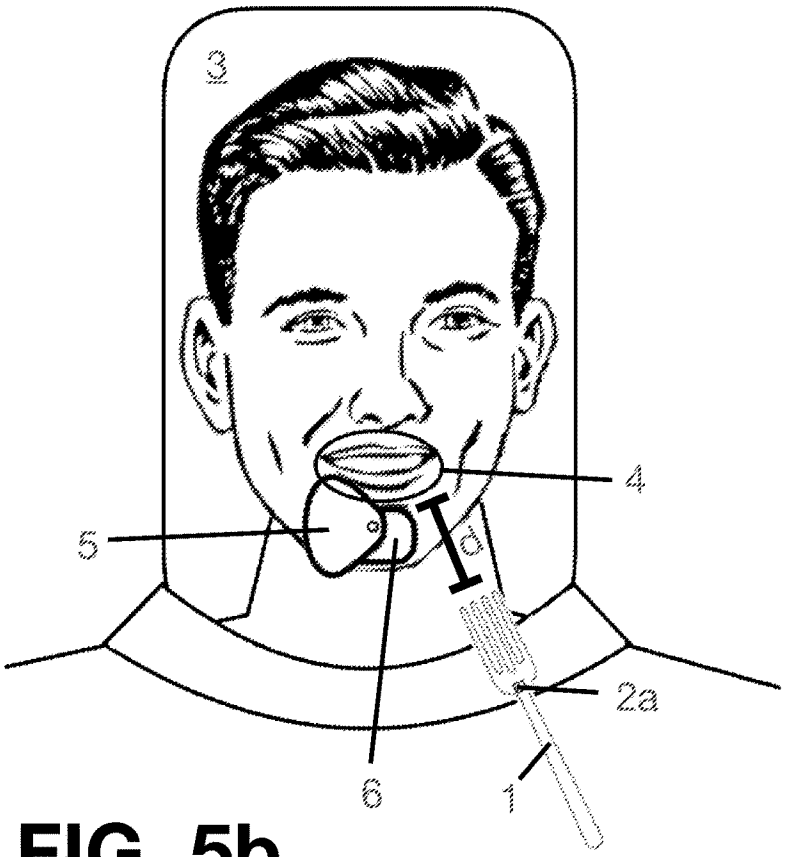
FIG. 5*b* shows the system of the present invention implemented on a helmet where the utensil is within a predefined distance from the helmet.
Figure 5A:
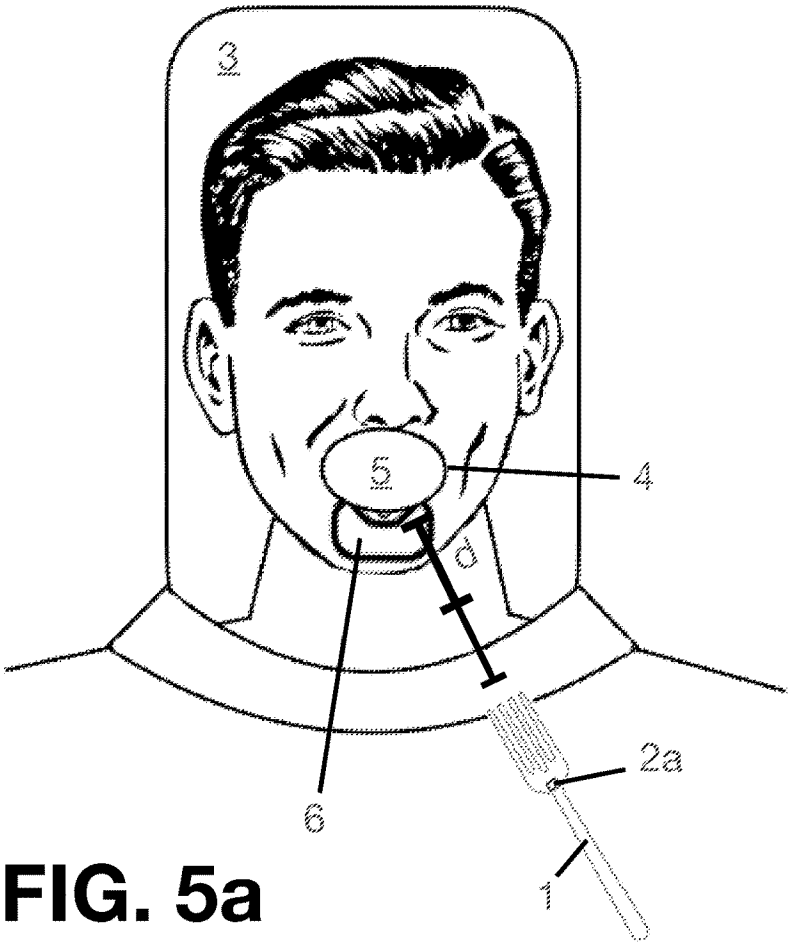
FIG. 5*a* shows the system of the present invention implemented on a helmet where the utensil is outside a predefined distance from the helmet.

FIGS. 3*a* and 3*b* illustrate the invention where the protective covering is a face mask (3). However, the same principle of operation applies where the protective covering is a face shield as illustrated in FIGS. 4*a* and 4*b*, and where the protective covering is a helmet completely covering a person's head as illustrated in FIGS. 5*a* and 5*b*. The helmet used according to the invention, is made from a lightweight and transparent material from the neck up and rests on the shoulders of the person such that the head can be freely moved without contacting any portion of the helmet. Additionally, the helmet contains a ventilation system (preferably fan-driven) using filters (such as HEPA filters) on both the intake and exhaust ports. This ventilation system can provide an internal positive pressure to help keep the airborne contaminants out of the helmet. All mechanical components are mounted on the section of the helmet that is below the neck. The upper transparent section of the helmet is removable for sterilization or replacement. In the face mask embodiment, the detection and actuation elements are preferably located on or near the face mask hung around the person's neck and the covering element (5) is located on the face mask.

Specifically, the servomotor (6) and the covering element (5) are positioned on the face mask in such a way that the covering element (5) coincides with the location of the mouth opening (4) on the face mask (3) when located in a blocked position. The covering element (5) will continue to keep the mouth opening (4) blocked as long as no RFID/NFC activation signal is received by the RFID/NFC transceiver module (2*b*) provided on the protective covering (3) and the distance between the RFID/NFC tag (2*a*) and the RFID/NFC transceiver module (2*b*) is greater than a predefined distance d. Once the RFID/NFC tag (2*a*) is in proximity to the face mask (3) within the predefined distance d, the RFID/NFC activation signal is transmitted by the RFID/NFC tag (2*a*) and received by the RFID/NFC transceiver module (2*b*). According to this example, the RFID/NFC transceiver module (2*b*) provided on the face mask (3) transmits an interrogation signal that is received and read by a passive RFID/NFC tag (2*a*) provided on the fork (1) when the fork (1) is in proximity to the mouth opening (4) within the predefined distance d. As a consequence, the RFID/NFC tag (2*a*) transmits the RFID/NFC activation signal to the RFID/NFC transceiver module (2*b*) where the processing module (7) will determine whether a partial or complete unblocking of the mouth opening (4) is required based on the information contained in the RFID/NFC activation signal. As previously explained, the RFID/NFC activation signal can either contain an ID associated to a complete unblocking situation (e.g., using a fork) or a partial unblocking situation (e.g., using a straw). Once the processing module (7) determines if a partial or complete unblocking of the mouth opening (4) is required, an output of the processing module (7) selectively actuates the servomotor (6) which will in turn move the covering element (5) to at least partially expose the person's mouth through the mouth opening (4) as shown in FIG. 3*b*. This allows a person to comfortably place the food carried by the fork inside the mouth (or a straw inside the mouth) and to remove the fork (or straw) out of the face mask (3) once finish. Then, once the fork (1) is outside the predefined distance d and the RFID/NFC activation signal is no longer received at the RFID/NFC transceiver module (2*b*), the processing module (7) selectively actuates the servomotor (6) which will in turn move the covering element (5) in an opposite direction to completely cover the mouth opening (4). It is also envisioned, that when the covering element (5) is moved to unblock the mouth opening (4), a delay timer (with a fixed or configurable duration) can be started to maintain the covering element (5) in the unblocked position and to automatically have the servomotor (6) move the covering element (5) back to the blocked position once the delay timer is over. These steps are continuously repeated while a person is eating or drinking.

Figure 6B:
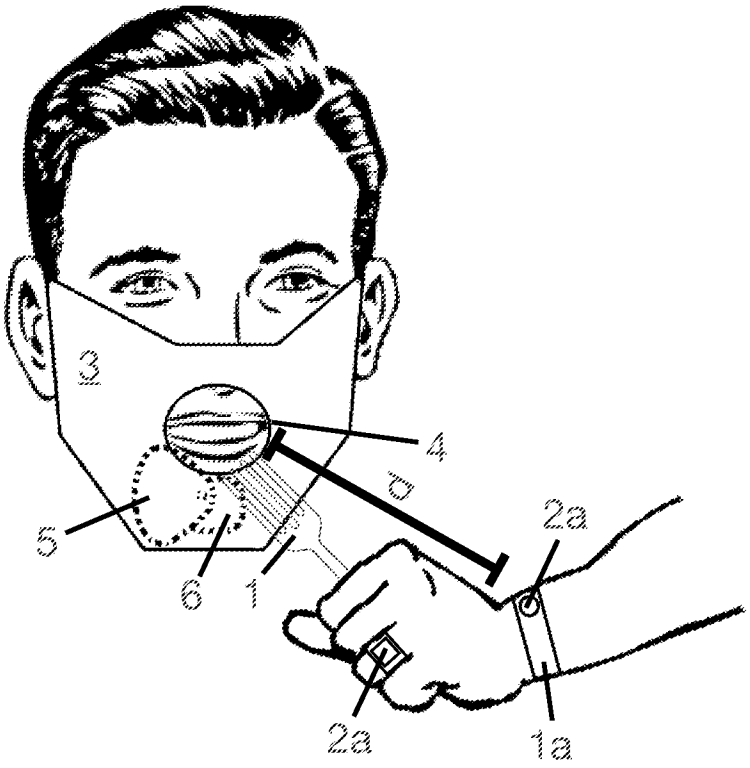
FIG. 6*b* shows the system of the present invention implemented on a face mask where the wearable device is within a predefined distance from the face mask.
Figure 6A:
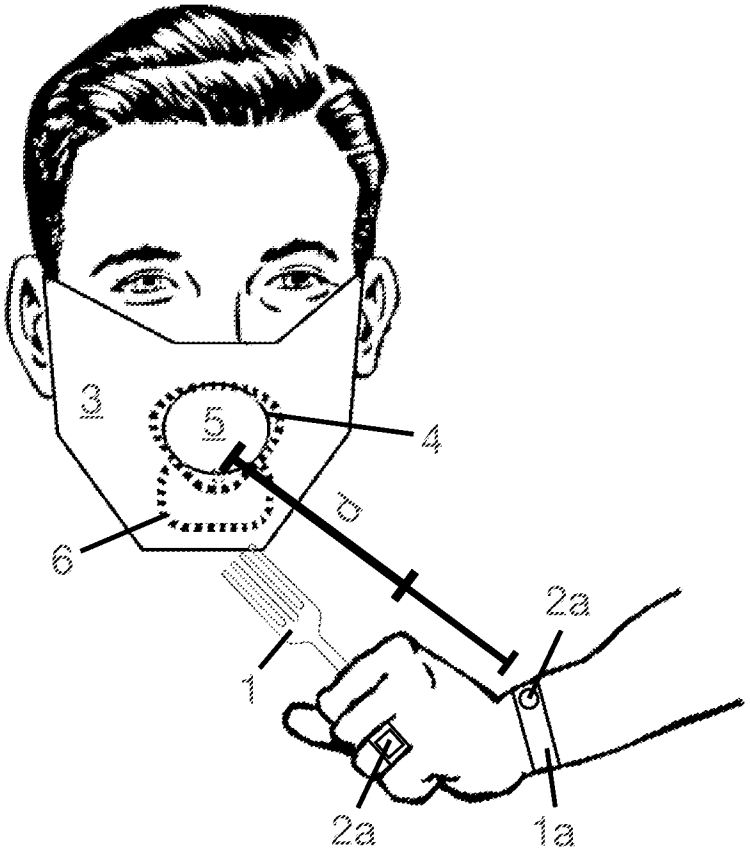
FIG. 6*a* shows the system of the present invention implemented on a face mask where the wearable device is outside a predefined distance from the face mask.

FIGS. 6*a* and 6*b* illustrate the activation element (2*a*) being provided on an activating device wearable by the person. According to this example, the wearable device (1*a*) can be a wristband, a watch, smartwatch, a bracelet or a ring. Similar to the operation with a utensil (1), the covering element (5) will continue to keep the mouth opening (4) blocked as long as no RFID/NFC activation signal is received by the RFID/NFC transceiver module (2*b*) provided on the protective covering (3) and the distance between the RFID/NFC tag (2*a*) on the wearable device (1*a*) and the RFID/NFC transceiver module (2*b*) is greater than a predefined distance d. Once the RFID/NFC tag (2*a*) on the wearable device (1*a*) is in proximity to the face mask (3) within the predefined distance d, the RFID/NFC activation signal is transmitted by the RFID/NFC tag (2*a*) on the wearable device (1*a*) and received by the RFID/NFC transceiver module (2*b*). According to this example, the RFID/NFC transceiver module (2*b*) provided on the face mask (3) transmits an interrogation signal that is received and read by a passive RFID/NFC tag (2*a*) on the wearable device (1*a*) when the wearable device (1*a*) is in proximity to the mouth opening (4) within the predefined distance d. As a consequence, the RFID/NFC tag (2*a*) on the wearable device (1*a*) transmits the RFID/NFC activation signal to the RFID/NFC transceiver module (2*b*) where the processing module (7) will determine whether a partial or complete unblocking of the mouth opening (4) is required based on the information contained in the RFID/NFC activation signal. According to this example, the RFID/NFC activation signal can contain information related at least to the direction, orientation and/or speed of the wearable device (1*a*) which can be used by the processing module (7) to distinguish for example between using a fork (complete unblocking) or using a straw (partial unblocking). The wearable device (1*a*) can contain the hardware and software necessary to measure and generate this information (e.g., accelerometer, gyroscope).

It is envisioned, that this information can be obtained, managed and generated by a mobile application running on the smartwatch. In addition, the operating parameters of the movement mechanism (6), the processing module (7) and/or the receiving element (2*b*) can be calibrated and/or set directly at the processing module (7), via the mobile application running on the smartwatch, and/or via a software application running on a separate device. It must be understood that a communication module must be provided so that any remote device is able to communicate (unidirectionally or bi-directionally) with the processing module (7).

Once the processing module (7) determines if a partial or complete unblocking of the mouth opening (4) is required, an output of the processing module (7) selectively actuates the servomotor (6) which will in turn move the covering element (5) to at least partially expose the person's mouth through the mouth opening (4) as shown in FIG. 6*b*. This allows a person to comfortably place the food carried by the fork inside the mouth (or a straw inside the mouth) and to remove the fork (or straw) out of the face mask (3) once finish. Then, once the wearable device (1*a*) is outside the predefined distance d and the RFID/NFC activation signal is no longer received at the RFID/NFC transceiver module (2*b*), the processing module (7) selectively actuates the servomotor (6) which will in turn move the covering element (5) in an opposite direction to completely cover the mouth opening (4) as shown in FIG. 6*a*. It is also envisioned, that when the covering element (5) is moved to unblock the mouth opening (4), a delay timer (with a fixed or configurable duration) can be started to maintain the covering element (5) in the unblocked position and to automatically have the servomotor (6) move the covering element (5) back to the blocked position once the delay timer is over. These steps are continuously repeated while a person is eating or drinking.

Although the present invention has been described herein with reference to the foregoing exemplary embodiment, this embodiment does not serve to limit the scope of the present invention. Accordingly, those skilled in the art to which the present invention pertains will appreciate that various modifications are possible, without departing from the technical spirit of the present invention.

We claim:

1. A system for safe eating and drinking during airborne contamination comprising:

a protective covering configured to cover at least a mouth of a person, wherein said protective covering comprises a mouth opening positioned in front of said mouth;

a receiving element provided on said protective covering and an activating element provided on an activating device external to said protective covering; and a servomotor with an output shaft coupled to a covering element, wherein said servomotor selectively moves said covering element to at least partially unblock said mouth opening based on a wireless activation signal and a distance between said activating element and said receiving element being within a predefined distance and to completely block said mouth opening based on the wireless activation signal and the distance between said activating element and said receiving element being greater than said predefined distance.

2. The system of claim 1, wherein said servomotor moves said cover element to completely unblock the mouth opening when said activating element is within said predefined distance.

3. The system of claim 1, wherein said mouth opening remains at least partially unblocked for a predefined amount of time.

4. The system of claim 1, wherein said mouth opening remains at least partially unblocked as long as said wireless activation signal is received by said receiving element.

5. The system of claim 1, wherein said activating device is a utensil.

6. The system of claim 1, wherein said activating device is a wearable device configured to be worn by said person.

7. The system of claim 5, wherein said utensil is a fork, a spoon, a knife, chopsticks, tongs, a cup, a spatula, a turner, a food grabbing element or a straw.

8. The system of claim 6, wherein said wearable device is a glove, a wristband, a watch, smartwatch, a bracelet or a ring.

9. The system of claim 1, wherein said protective covering comprises a face mask configured to cover a nose and the mouth of said person.

10. The system of claim 1, wherein said protective covering comprises a face shield configured to cover a face of said person.

11. The system of claim 1, wherein said protective covering comprises a helmet configured to completely cover a head of said person.

12. The system of claim 1, wherein said servomotor linearly moves said cover element in relation to said mouth opening.

13. The system of claim 1, wherein said servomotor rotatably moves said cover element in relation to said mouth opening.

14. The system of claim 1, wherein said receiving element comprises a wireless transceiver module and said activating element comprises a wireless identification device that transmits said wireless activating signal so that the servomotor moves said cover element to at least partially unblock the mouth opening when said wireless activating signal is received by said wireless transceiver module.

15. The system of claim 1, wherein said receiving element comprises a wireless transceiver module and said activating element comprises a wireless identification device that transmits said wireless activating signal so that the servomotor moves said cover element to completely block the mouth opening when said wireless activating signal is not received by said wireless transceiver module.

16. The system of claim 1, wherein said wireless activation signal is a radio frequency (RF) signal transmitted by one of: Bluetooth, Bluetooth Low Energy (BLE), ZigBee, Z-Wave, 6LoWPAN, Thread, 2G, 3G, 4G, LTE, GSM, NB-IoT, 5G, NFC, RFID, SigFox, LoRaWAN, Ingenu, Weightless-N/P/W, ANT(+), DigiMesh, MiWi, EnOcean, Dash7, WirelessHART, and WIFI.

17. The system of claim 1, wherein said receiving element comprises a first magnetic module and said activating element comprises a second magnetic module that transmits said wireless activating signal so that the servomotor moves said cover element to at least partially unblock the mouth opening when said wireless activating signal is a magnetic signal received by said first magnetic module.

18. The system of claim 1, wherein said receiving element comprises a first magnetic module and said activating element comprises a second magnetic module that transmits said wireless activating signal so that the servomotor moves said cover element to completely block the mouth opening when said wireless activating signal is a magnetic signal not received by said first magnetic module.

19. The system of claim 1, wherein said receiving element comprises an infrared (IR) sensor and said activating element comprises an IR light source that transmits said wireless activating signal so that said servomotor moves the cover element to at least partially unblock the mouth opening when said wireless activating signal is an IR signal received by said IR sensor.

20. The system of claim 1, wherein said receiving element comprises an infrared (IR) sensor and said activating element comprises an IR light source that transmits said wireless activating signal so that said servomotor moves the cover element to completely block the mouth opening when said wireless activating signal is an IR signal not received by said IR sensor.

21. The system of claim 1, wherein said activating element is removably coupled to said activating device.

* * * * *